US008424233B2

(12) United States Patent
Cronin et al.

(10) Patent No.: US 8,424,233 B2
(45) Date of Patent: Apr. 23, 2013

(54) PROJECTILE FOR A STACKED PROJECTILE WEAPON

(75) Inventors: Joseph F. Cronin, Queensland (AU); Sean P. O'Dwyer, Queensland (AU); Roger H. Thompson, Queensland (AU)

(73) Assignee: Metal Storm Limited, Richlands, Queensland (AU)

( * ) Notice: Subject to any disclaimer, the term of this patent is extended or adjusted under 35 U.S.C. 154(b) by 643 days.

(21) Appl. No.: 12/179,934

(22) Filed: Jul. 25, 2008

(65) Prior Publication Data

US 2010/0043628 A1 Feb. 25, 2010

Related U.S. Application Data

(63) Continuation-in-part of application No. 12/161,234, filed as application No. PCT/AU2007/000032 on Jan. 17, 2007, now abandoned.

(30) Foreign Application Priority Data

Jan. 17, 2006 (AU) ..... 2006900223

(51) Int. Cl.
*F41A 19/00* (2006.01)

(52) U.S. Cl.
USPC ..... 42/84; 102/431; 102/438; 102/520; 102/523

(58) Field of Classification Search ..... 42/84; 102/431, 102/438, 520, 523
See application file for complete search history.

(56) References Cited

U.S. PATENT DOCUMENTS

| | | | | | |
|---|---|---|---|---|---|
| 1,376,530 | A | * | 5/1921 | Greener | 102/438 |
| 2,099,993 | A | * | 11/1937 | Tauschek | 89/125 |
| 2,313,030 | A | | 3/1943 | Tauschek | |
| 2,897,757 | A | * | 8/1959 | Kulluck | 102/438 |
| 3,139,795 | A | * | 7/1964 | Altschuler | 89/1.818 |
| 3,680,485 | A | * | 8/1972 | Zaid et al. | 102/506 |
| 4,878,432 | A | | 11/1989 | Mikhail | |
| 4,989,517 | A | * | 2/1991 | Adimari et al. | 102/388 |
| 5,020,437 | A | * | 6/1991 | Rieger et al. | 102/489 |
| 5,880,397 | A | * | 3/1999 | Crilly | 102/443 |
| 5,988,071 | A | * | 11/1999 | Taylor | 102/473 |
| 6,021,716 | A | * | 2/2000 | Taylor | 102/517 |

(Continued)

FOREIGN PATENT DOCUMENTS

| | | | |
|---|---|---|---|
| WO | WO-2000/062005 | A1 | 10/2000 |
| WO | WO-03/023309 | A1 | 3/2003 |

(Continued)

OTHER PUBLICATIONS

"PCT International Search Report in PCT/AU2007/000032", (Mar. 29, 2007), 7 pp.

(Continued)

*Primary Examiner* — Michelle Clement
(74) *Attorney, Agent, or Firm* — Servilla Whitney LLC

(57) ABSTRACT

Clips for use with projectiles and projectile stacking systems in which individual projectiles are clipped together to form a stack are disclosed. The projectiles may be joined individually by a user before loading in a barrel, or during a loading process assisted by features on the breech of the barrel. The tail of each projectile includes a set of clips which engage the nose of a trailing projectile in the stack. Projectiles may be withdrawn from barrel and unclipped as required by the user.

20 Claims, 18 Drawing Sheets

U.S. PATENT DOCUMENTS

| | | | | |
|---|---|---|---|---|
| 6,223,642 | B1 * | 5/2001 | O'Dwyer | 89/7 |
| 6,301,819 | B1 * | 10/2001 | O'Dwyer | 42/84 |
| 6,431,076 | B1 * | 8/2002 | O'Dwyer | 102/525 |
| 6,722,252 | B1 * | 4/2004 | O'Dwyer | 89/1.41 |
| 6,748,870 | B2 * | 6/2004 | Heidenreich et al. | 102/431 |
| 7,194,943 | B2 * | 3/2007 | O'Dwyer | 89/28.05 |
| 7,194,945 | B2 * | 3/2007 | O'Dwyer | 89/135 |
| 7,373,884 | B2 * | 5/2008 | Haeselich | 102/438 |
| 7,475,635 | B2 * | 1/2009 | Bambach | 102/438 |
| 7,475,636 | B2 * | 1/2009 | O'Dwyer et al. | 102/438 |
| 7,698,849 | B2 | 4/2010 | O'Dwyer et al. | |
| 7,707,941 | B2 * | 5/2010 | Bishop et al. | 102/438 |
| 7,743,705 | B2 * | 6/2010 | O'Dwyer | 102/438 |
| 7,984,675 | B2 | 7/2011 | O'Dwyer | |
| 2003/0127010 | A1 * | 7/2003 | O'Dwyer | 102/335 |
| 2004/0231219 | A1 * | 11/2004 | O'Dwyer | 42/84 |
| 2006/0254453 | A1 * | 11/2006 | Leal et al. | 102/513 |
| 2007/0056460 | A1 * | 3/2007 | O'Dwyer et al. | 102/374 |
| 2007/0068414 | A1 * | 3/2007 | O'Dwyer et al. | 102/374 |
| 2008/0022879 | A1 | 1/2008 | O'Dwyer et al. | |
| 2009/0120317 | A1 * | 5/2009 | Bishop et al. | 102/438 |
| 2009/0241795 | A1 | 10/2009 | O'Dwyer et al. | |
| 2009/0241796 | A1 * | 10/2009 | Bambach | 102/438 |
| 2010/0043628 | A1 | 2/2010 | Cronin et al. | |
| 2010/0101443 | A1 * | 4/2010 | Rosales et al. | 102/438 |
| 2010/0282111 | A1 * | 11/2010 | O'Dwyer | 102/438 |

FOREIGN PATENT DOCUMENTS

| | | | |
|---|---|---|---|
| WO | WO-03/089871 | | 10/2003 |
| WO | WO-2004/001326 | A1 | 12/2003 |
| WO | WO-2004/005836 | A1 | 1/2004 |
| WO | WO-2004/070307 | A1 | 8/2004 |
| WO | WO-2004/102108 | A1 | 11/2004 |
| WO | WO 2007082334 | A1 * | 7/2007 |
| WO | WO 2007095673 | A1 * | 8/2007 |
| WO | WO 2008070923 | A1 * | 6/2008 |
| WO | WO 2010088741 | A1 * | 8/2010 |

OTHER PUBLICATIONS

Non-Final Office Action in U.S. Appl. No. 12/161,234, mailed Sep. 9, 2011, 12 gs.

* cited by examiner

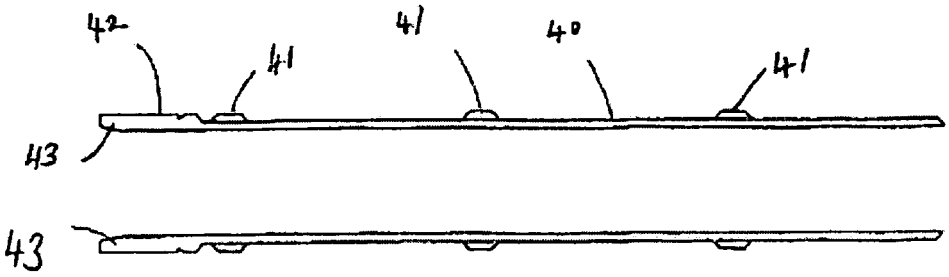
FIGURE 4
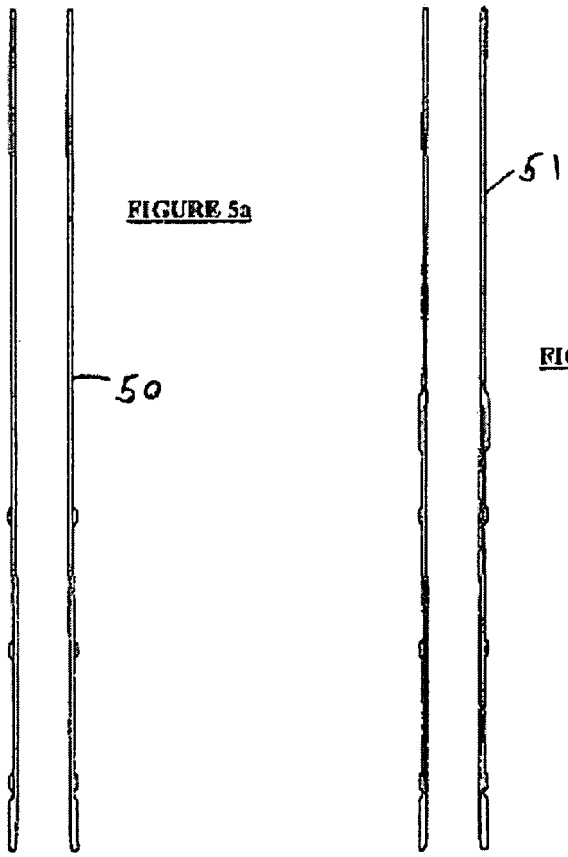
FIGURE 5a
FIGURE 5b

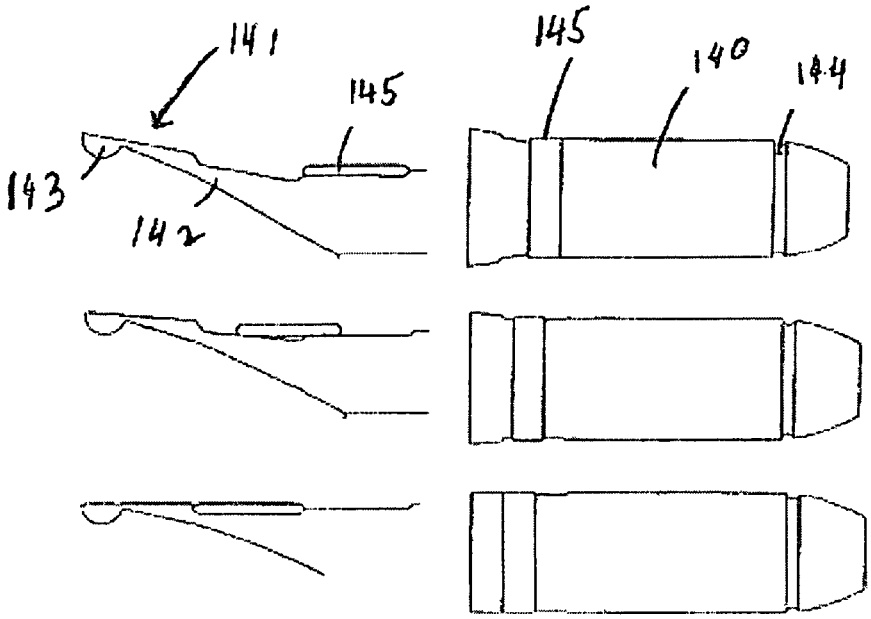
FIGURE 14a
FIGURE 14b
FIGURE 14c
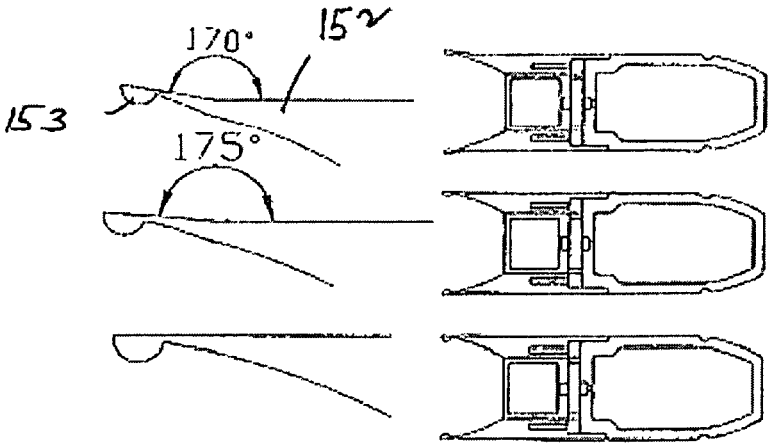
FIGURE 15a
FIGURE 15b
FIGURE 15c

PROJECTILE FOR A STACKED PROJECTILE WEAPON

CROSS-REFERENCE TO RELATION APPLICATIONS

This application is a continuation-in-part of U.S. patent application Ser. No. 12/161,234, filed on Jul. 17, 2008, which is a 35 U.S.C. §371 filing of International Application No. PCT/AU2007/000032, which claims the benefit under 35 U.S.C. §119 of AU2006900223, filed on Jan. 17, 2007, each of which is incorporated by reference thereto in its entirety.

FIELD OF THE INVENTION

This invention relates to clips for projectile launchers, projectiles, and projectile launchers including projectiles which may be individually loaded into a stacked projectile launcher, or which may be joined together to form a stack before loading, by an operator in the field.

BACKGROUND

In a stacked projectile launcher the projectiles are fired sequentially from a stack contained in the barrel. These launchers offer an advantage in that the projectiles have no cartridges and can be fired electronically and relatively rapidly. However, propellant gases created by firing of the leading projectile can ignite the propellant charges that are provided for projectiles further down the stack. A sealing system is therefore required, such as forward or reverse wedging, in which a part of each projectile is forced into a circumferential contact with the bore the barrel. Alternatively the propellant charges may be sealed within chambers provided either externally to the barrel or internally to the projectiles themselves.

Another problem that must be overcome in stacked projectile launchers relates to the ease of loading and reloading. In some existing launchers the projectiles cannot be carried and loaded by operators in the field, so an empty launcher must be returned to base. In other launchers the projectiles must be carried and loaded as preformed stacks, so operators are faced with the dilemma of how to deal with a stack which has only been partially fired, in order to be fully prepared for the next event in e.g. a combat operation. An operator is unlikely to be comfortable carrying a partially loaded launcher into a life threatening situation, or carrying a partly empty stack back to base to be refilled.

SUMMARY

In one aspect, a projectile for a stacked projectile launcher is provided, comprising: a propellant charge which is sealed against ignition of charges in other projectiles, an engagement mechanism having a nose part and a tail part for engagement respectively with leading and trailing projectiles during a loading process, a firing system for the propellant, and a payload.

In a specific embodiment, the nose part of the engagement mechanism is engaged by the tail part of a leading projectile during the loading process. Similarly, the tail part of the engagement mechanism is engaged by the nose part of a trailing projectile during the loading process. The loading process includes insertion of individual projectiles into a breech portion of the launcher to form a stack.

In one embodiment, the nose part of the engagement mechanism includes a lateral groove around the nose of the projectile. The tail part of the engagement mechanism includes one or more longitudinal clips.

In a specific embodiment, the tail part of the engagement mechanism is actuated by passage through a breech portion of the launcher on insertion of a trailing projectile. The tail part of the engagement mechanism has a normally open condition which is closed on engagement with the trailing projectile. The tail part remains closed after firing of the projectile but reopens if the projectile is unloaded.

Another aspect the invention resides in a method of loading a launcher with projectiles, including: inserting a leading projectile into a breech portion of the launcher, inserting a trailing projectile into the breech portion behind the leading projectile to form a stack, and forming an engagement between a tail part of the leading projectile and a nose part of the trailing projectile.

In a specific embodiment, the projectiles are inserted longitudinally through a common aperture and the trailing projectile urges the leading projectile further into the breech portion. A normally open mechanism on the tail part of the leading projectile is closed to engage the nose of the trailing projectile as the leading projectile is pushed further into the breech portion by the trailing projectile. In a more specific embodiment, a plug is inserted into the breech portion after the trailing projectile and forming an engagement between a tail part of the trailing projectile and the plug.

In one embodiment, the engagement is formed between one or more longitudinal clips in the tail part of the leading projectile and a lateral groove in the nose part of the trailing projectile. The engagement between the projectiles is broken by firing the leading projectile or by withdrawing the trailing projectile from the breech portion.

Another aspect the invention pertains to a clip for use with in a projectile launcher, including: a breech portion with a barrel which receives a series of projectiles to form a stack, and a firing system which is aligned with the stack and activates respective primers in the projectiles, wherein the barrel has an entry portion which actuates an engagement mechanism between consecutive projectiles.

In a specific embodiment, the entry portion includes an aperture having an edge which closes a tail part of each leading projectile into engagement with a nose part of a corresponding trailing projectile as the stack is formed.

In a more specific embodiment, the weapon includes a plug which retains the stack within the barrel and engages the trailing projectile in the stack. In an even more specific embodiment, the firing system includes an inductive subsystem for each projectile in the stack.

Embodiments of the invention also reside in any alternative combination of features that are indicated in this specification. All equivalents of these features are deemed to be included whether or not expressly set out.

BRIEF DESCRIPTION OF THE DRAWINGS

Embodiments of the invention will be described with respect to the accompanying drawings, of which:

FIG. 4 shows a receiver for a stacked projectile weapon capable of firing the projectile;

FIGS. 5*a, b* show how the receiver may be extended to form a barrel;

FIGS. 14*a*, 14*b*, 14*c* indicate a further clipping action;

FIGS. 15*a*, 15*b*, 15*c*, 15*d* indicate a further clipping action;

DETAILED DESCRIPTION

Figure 1:
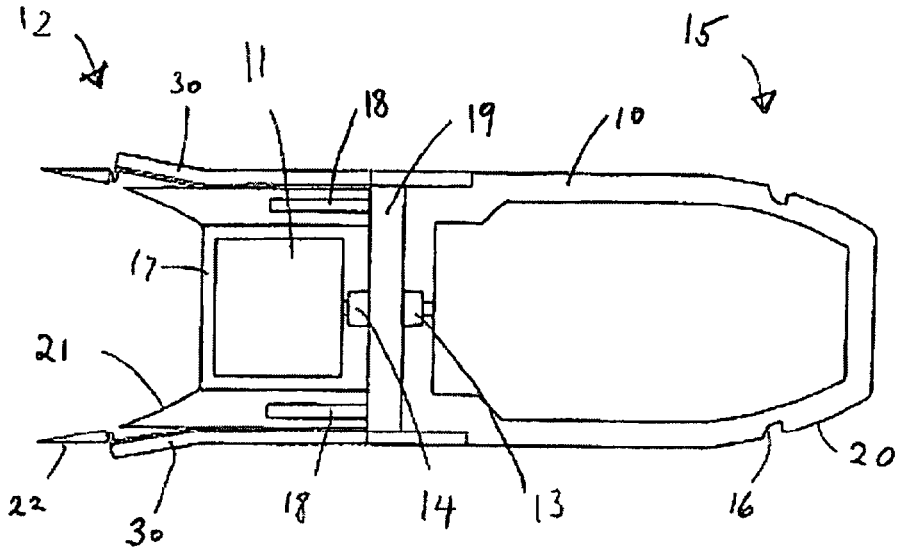
FIG. 1 is a cross section through a projectile with stacking clips.

Referring to the drawings, it will be appreciated that the invention may be implemented in a variety of different ways for a range of different weapons or other projectile launchers. Both military and civilian purposes may be envisaged. This description is provided by way of example only. It will also be appreciated that projectiles and barrels described herein have generally cylindrical symmetry, so that most of the features shown in the drawings have a degree of rotational symmetry about a longitudinal axis.

FIG. 1 is a cross sectional view of the main components of a projectile for a stacked projectile weapon. The projectile includes a payload container 10, such as a warhead, a propellant charge 11 and a tail assembly 12. Primer 13 activates the warhead and primer 14 ignites the propellant. The projectile is adapted to be stackable nose to tail with a number of identical projectiles in the barrel of the weapon. Nose portion 15 has a roughly convex outer surface 20 shaped to correspond with a roughly concave inside surface 21 of the tail assembly. The surface of the nose portion also includes a groove 16 while the tail assembly includes a set of clips 30, so that the nose of each trailing projectile may engage the tail of a respective leading projectile in the stack.

Because the projectile in FIG. 1 is to be used in a stack, the propellant must be sealed against ignition gases which fill the barrel of the weapon after each projectile is fired. In this example the propellant is sealed within a casing 17 which is resistant to the ignition gases produced by other projectiles. The casing typically includes a portion which ruptures outwards under the higher pressures which are produced when propellant 11 is ignited. A range of other systems such as wedge sealing may be employed instead of or in addition to the casing system.

In FIG. 1 the projectile is fired from the weapon by way of an inductive system having an inductor 18 which interacts with a corresponding inductor in the barrel, and a signal detector 19 which receives output from the inductor 18 and determines whether the projectile is required to fire. The detector is typically programmed with a code and on receiving a signal containing the code from the inductor, the detector triggers the primer 14 to ignite the propellant. The detector may also arm the warhead through primer 13. Otherwise, the detector remains idle. Firing systems of this kind are known and need not be described in detail. A range of other electrical or mechanical firing systems are also possible for stacked projectile weapons.

Figure 2:
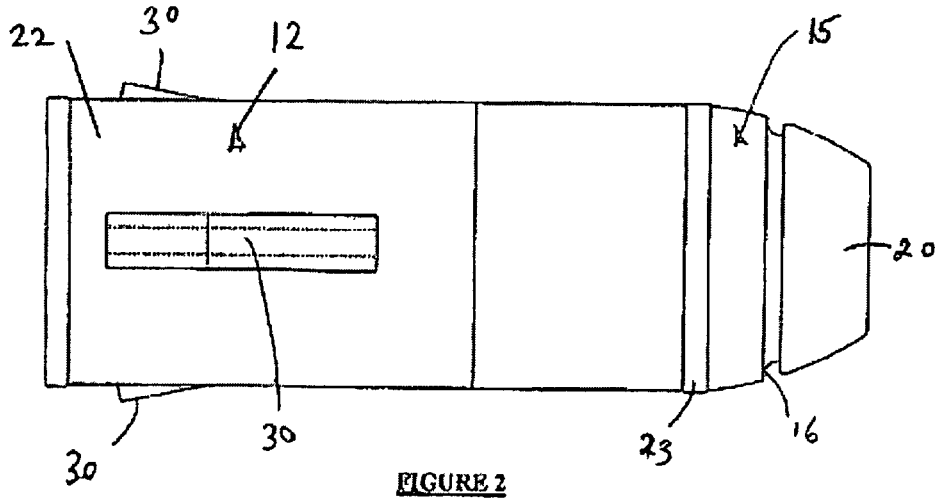
FIG. 2 is an external view of the projectile in FIG. 1.

FIG. 2 is an external view of the projectile in FIG. 1. The payload container 10 forms the nose portion 15 of the projectile in this example, and is shown connected to the tail assembly 12. When the projectile is stacked in a barrel the outer surface 20 of the nose portion is generally surrounded by skirt 22 of the tail assembly of a leading projectile (if any). The tail assembly also includes four clips 30 which engage groove 16 in the nose portion of a trailing projectile in the stack. Each portion also usually carries a driving band 23 which restricts forward gas flow along the barrel when the projectile is fired. There are many options for clipping a stack of projectiles together.

Figure 3A:
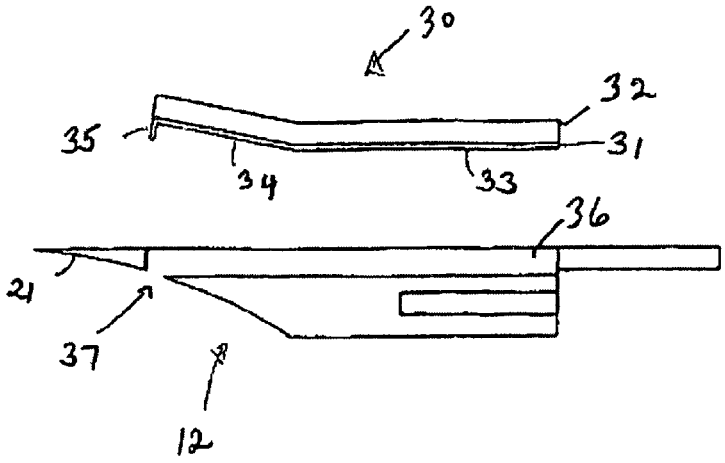
FIGS. 3*a, b, c* give further details of the stacking clips.
Figure 3B:
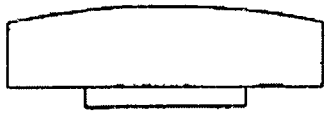
Figure 3C:
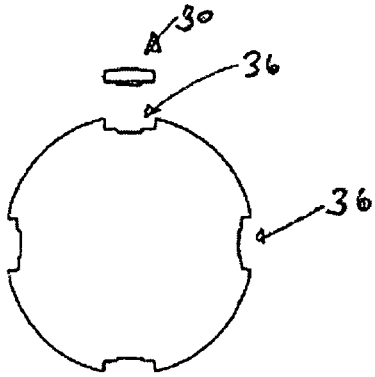

FIGS. 3*a, b, c* show a clip 30 in relation to parts of the tail assembly 12. Each clip is formed from a relatively stiff strip 31 which provides a spring action, and a larger flexible strip 32 which acts as a cover on the outer surface of the projectile. The strips are typically formed of suitable metals and fastened together and to the projectile using suitable means such as adhesive, welding or screws. The spring strip 31 is shaped in three parts, namely a base 33 which is fastened to the tail assembly of the projectile, an arm 34 which extends from the base and is biased outwards from the projectile, and a pin 35 which is carried by the arm and engages a trailing projectile during the loading process. The pin may take a wide variety of structures such as a simple fold in the end of the spring strip 31. Clip 30 is fastened into a slot 36 in the tail assembly so that the outer surface of the cover strip is flush with the outer surface of the projectile, and the pin part of the stiff strip is aligned with an aperture 37 in the tail assembly. Arm 34 holds the pin 35 in an open position away from the projectile and above the aperture 37.

FIG. 4 shows a projectile receiver which forms part of the barrel of a stacked projectile launcher or weapon. The receiver includes a tube 40 having a series of external ring-shaped inductors 41 which interact with inductors 19 in corresponding projectiles when the weapon is loaded. Breech 42 at one end of the tube receives individual projectiles from an operator during the loading process. The breech presents a tubular entry with a ramped portion 43 which interacts with the clips 30 to assist the engagement process between consecutive projectiles, as explained below. Unfired projectiles may also be removed through the breech if required. The other end of tube 40 is typically extended or joined to a further tube to form a full length barrel for the weapon or launcher. The barrel may take a wide range of structures and a wide range of firing mechanisms may also be employed.

FIGS. 5*a, b* show how the receiver in FIG. 4 may be extended in length 50 or joined to a further tube 51 to form the barrel of a launcher for stacked projectiles. It will be appreciated that various other components of the launcher, such as aiming and triggering systems have not been included, but will readily be understood by a skilled person.

Figure 6A:
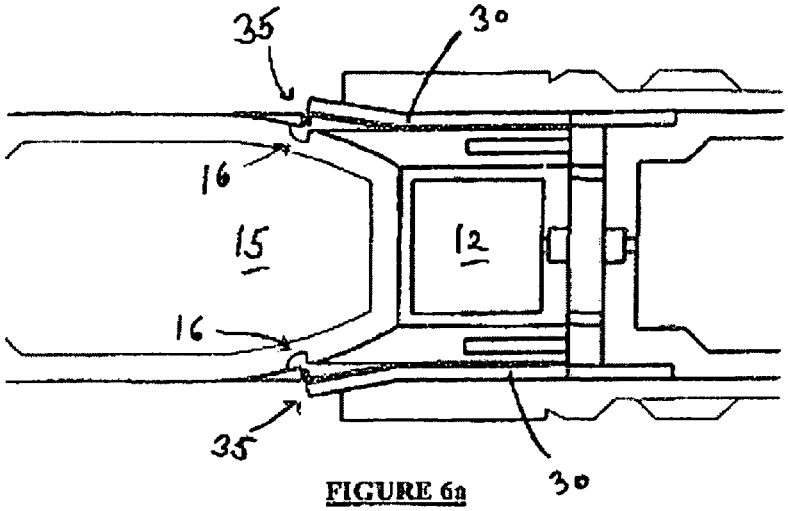
FIGS. 6*a, b* show two projectiles entering the receiver during the loading process.
Figure 6B:
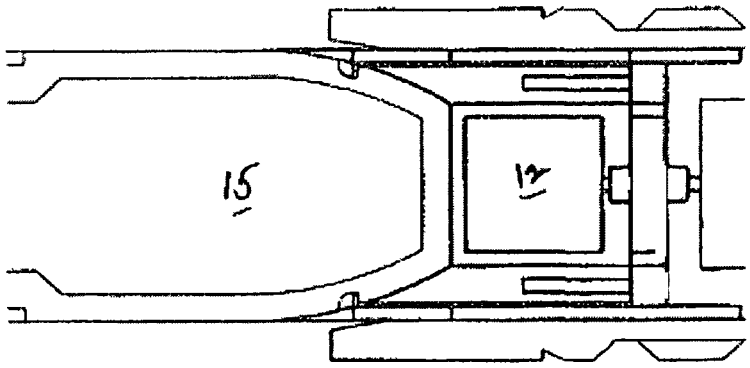

FIGS. 6*a, b* are a sequence showing how two projectiles are engaged nose to tail as an operator stacks the receiver. The tail assembly 12 of a first projectile at right is shown largely inside the breech of the receiver. The nose portion 15 of a second projectile at left is shown at the entry to the breech and in contact with the tail assembly of the first projectile. The operator is pushing the second projectile which in turn is urging the first projectile further into the receiver. In FIG. 6*a*, clips 30 in the tail assembly of the first projectile are adjacent the ramped portion of the breech and are still in their open state. In FIG. 6*b*, both projectiles have moved further into the receiver. Clips 30 have now been deflected and closed by the ramped portion of the breech so that pins 35 have each engaged the clip ring 16. Further pushing by the operator will move the second projectile into the breech to take the original position of the first projectile. Conversely, during an unloading process, the operator may pull the second projectile from the breech which will in turn pull the first projectile back into the breech. The clips 30 spring back to their initial open positions so that the projectile may be unloaded and loaded again in the same way.

Figure 7A:
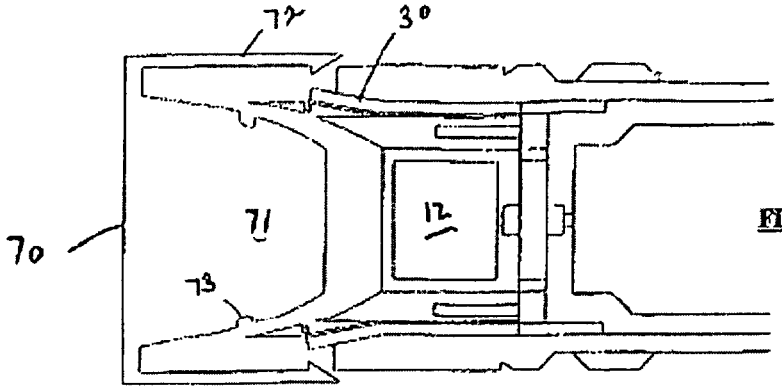
FIGS. 7*a, b, c* show how a breech plug is used to close the receiver once loaded.
Figure 7B:
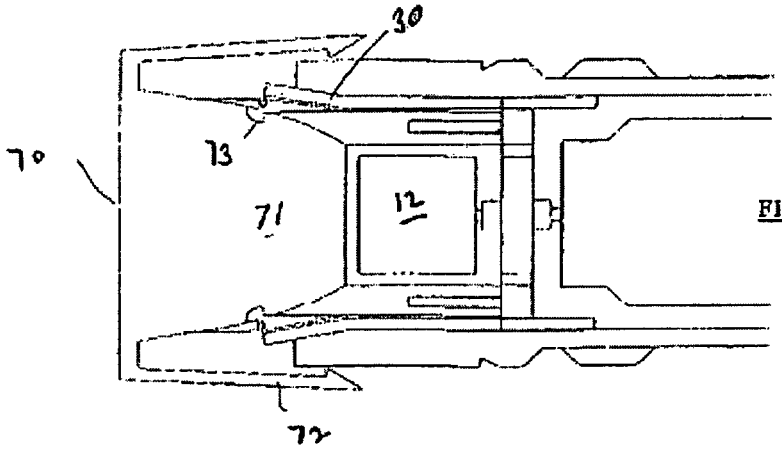
Figure 7C:
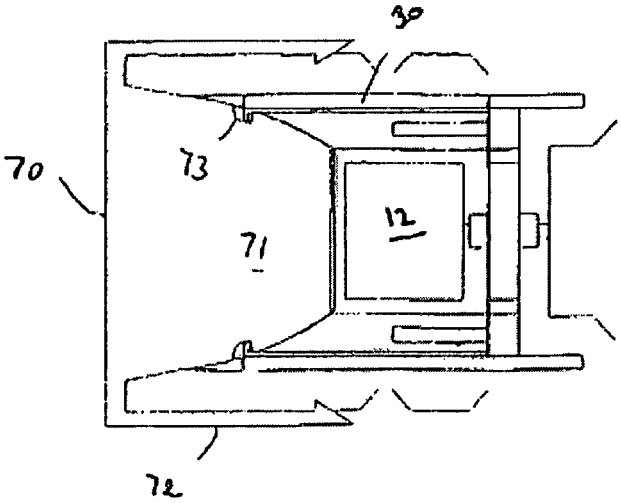

FIGS. 7*a, b* are a sequence showing how a plug 70 is used to close the breech after projectiles have been loaded into the receiver. The tail assembly 12 of the last projectile in the stack is shown largely inside the breech. The plug has a central portion 71 including a clip ring 73, similar in shape to the nose portion 15 of a projectile. The plug also has an outer cylindrical portion 72 which engages the outside of the breech. A wide range of plug designs are possible. In use, the operator pushes the plug, which in turn is urging the last projectile further into the receiver. In FIG. 7*a*, the plug has not yet contacted the projectile or the breech. Clips 30 in the tail assembly of the projectile are adjacent the ramped portion of the breech and are still in an open state. In FIG. 7*b*, the central portion 71 of the plug has contacted the tail assembly and the outer portion 72 has contacted the breech. In FIG. 7*c*, both the projectile and the central portion of the plug have moved into the breech. Clips 30 have now been closed by the ramped portion of the breech so that pins 35 in each clip have engaged the clip ring 73. The outer cylindrical portion of the plug has engaged the outside of the breech. The weapon may now be fired. Conversely in an unloading process, the plug may be disengaged and the projectile pulled back through the breech to be removed from the receiver.

Figure 8A:
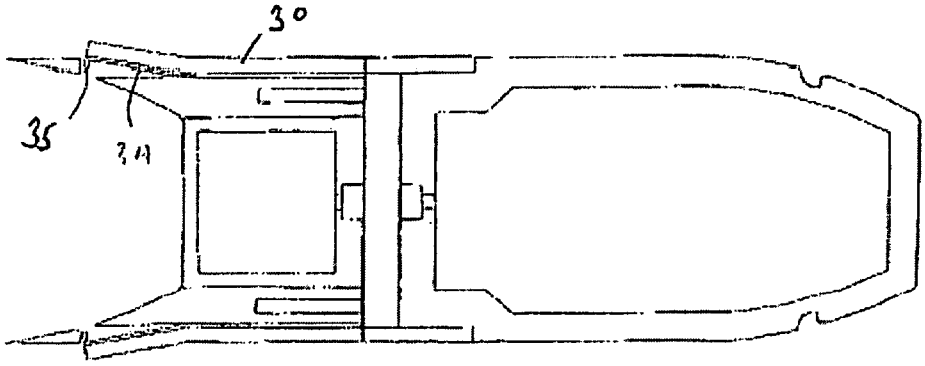
FIGS. 8*a, b, c* are views of the projectile showing the clips in open, closed and fired positions.
Figure 8B:
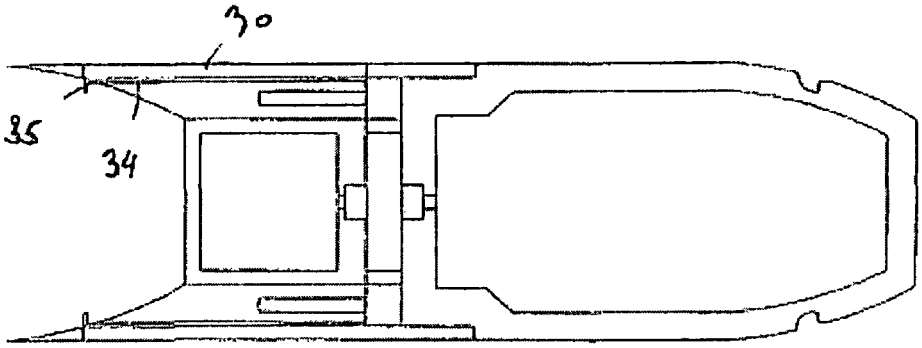
Figure 8C:
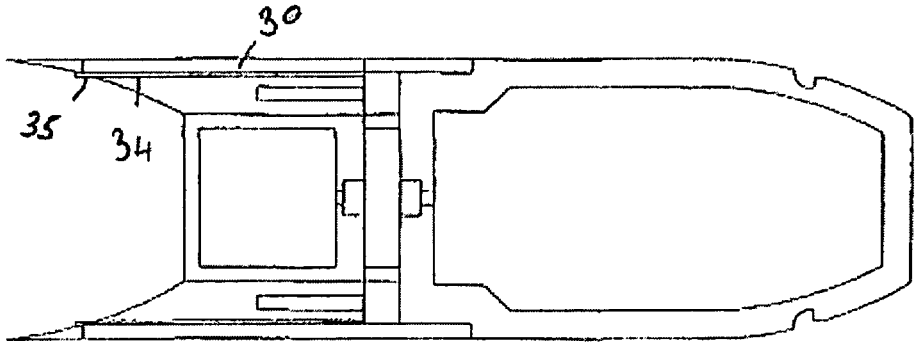

FIGS. 8*a, b, c* show a projectile in unloaded, loaded and fired conditions respectively. Clips 30 in the tail assembly are respectively open as a result of their respective spring strips 34, closed by the bore of the receiver, and then distorted on disengagement from the trailing projectile. In FIG. 8*a*, the pins 35 of each clip have been bent into alignment with the arms 34 by the resistance of a respective clip ring 16 during the firing action.

Figure 9A:
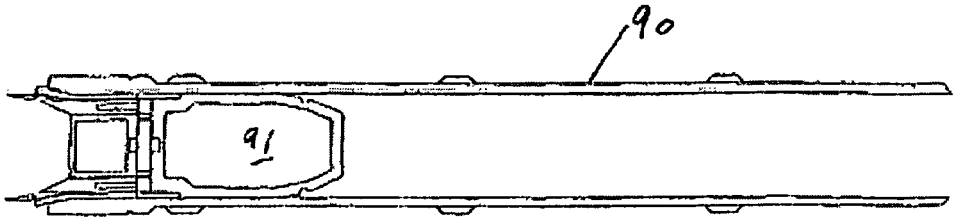
FIGS. 9*a, b, c, d* show loading of a receiver and closure with a breech plug.
Figure 9B:
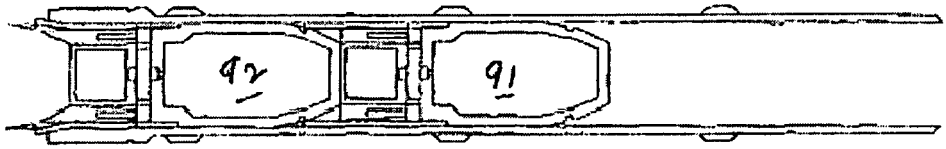
Figure 9C:
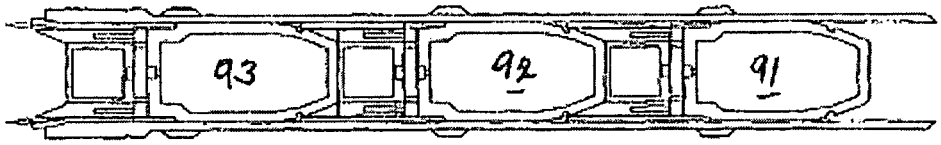
Figure 9D:
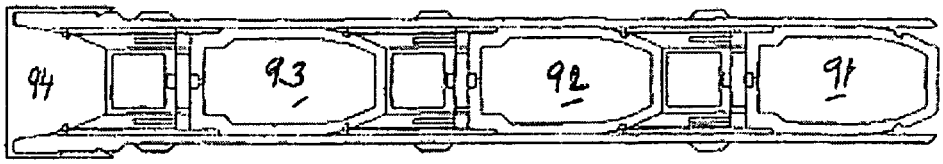

FIGS. 9*a, b, c, d* indicate a sequence showing a loading process in which a receiver 90 is stacked with three projectiles 91, 92, 93. The projectiles are individually loaded according to FIGS. 6*a, b* to form the stack. The receiver is then closed with closure or plug 94 according to FIGS. 7*a, b, c*.

Figure 10A:
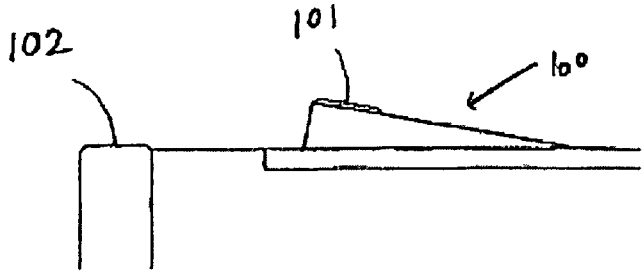
FIGS. 10*a, b, c* show clip variations.
Figure 10B:
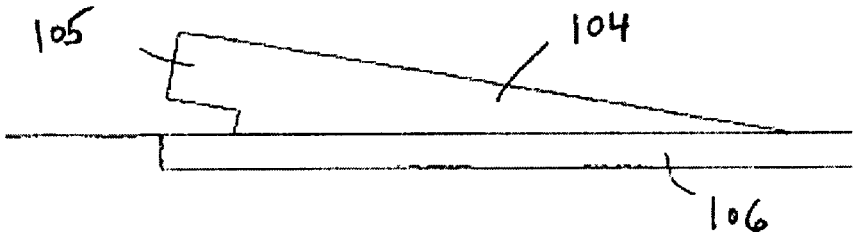
Figure 10C:
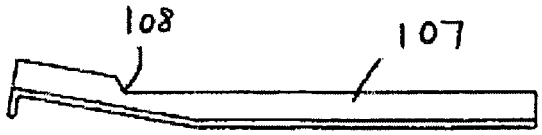
Figure 11A:
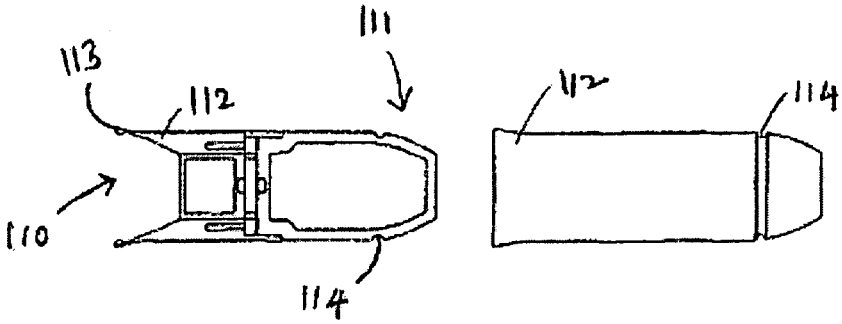
FIG. 11*a, b* show an alternative clipping system for projectiles.
Figure 11B:
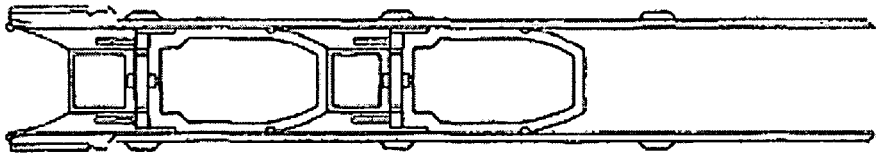

FIGS. 10*a, b, c* show possible variations in the stacking clips. In FIG. 10*a*, clip 100 has a pad 101 which corresponds in thickness to the driving band 102. The clip thereby contacts the bore of the receiver after the projectile is loaded and remains properly closed against flow of ignition gas in or out of the tail assembly. In FIG. 10*b*, the cover strip of clip 104 provides a flange 105 which extends fully around the underlying spring strip. The clip thereby closes into slot 106 and seals more effectively with the outer surface of the projectile to further reduce any flow of ignition gas. In FIG. 10*c*, the cover strip 107 includes a ledge 108 which interacts with the entry to the breech. This provides an increased level of resistance as the projectile is loaded into the receiver by the operator. FIGS. 11*a, b* show an alternative clipping system for engagement between projectiles in the stack. In FIG. 11*a*, the projectile has a tail assembly 110 and a nose portion 111. Skirt 112 in the tail assembly has a continuous lip 113, rather than a set of individual clips 30. The lip engages a clip ring 114 in the nose portion of a trailing projectile. FIG. 11*b* indicates a pair of projectiles of this kind stacked in a receiver. A breech plug for the receiver would be similarly modified.

Figure 12:
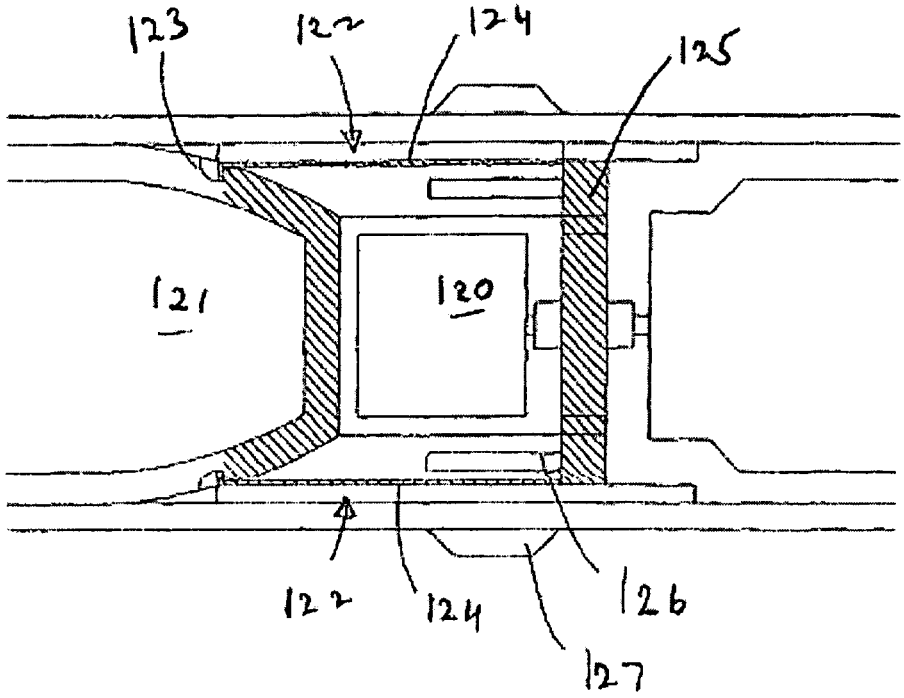
FIG. 12 shows how the clips may be included in a projectile arming system.

FIG. 12 indicates a safety system which arms projectiles only after they are loaded into a receiver and engaged with another projectile or with the breech plug. In this example, the tail assembly 120 of a leading projectile forms an electrical circuit (shaded) with the nose part 121 of a trailing projectile. Clips 122 in the tail assembly are closed and engaged with the clip ring 123. The ends of the spring strip 124 in each clip form electrical contacts with the signal detector 125 of the leading projectile and with the nose part of the trailing projectile. A number of circuits are formed between each pair of adjacent projectiles depending on the number of clips. Inductor 126 in the projectile interacts with inductor 127 in the receiver. However, the signal detector cannot fire the projectile unless the circuit through the clips of that particular projectile and nose of the next projectile are complete.

Figure 13:
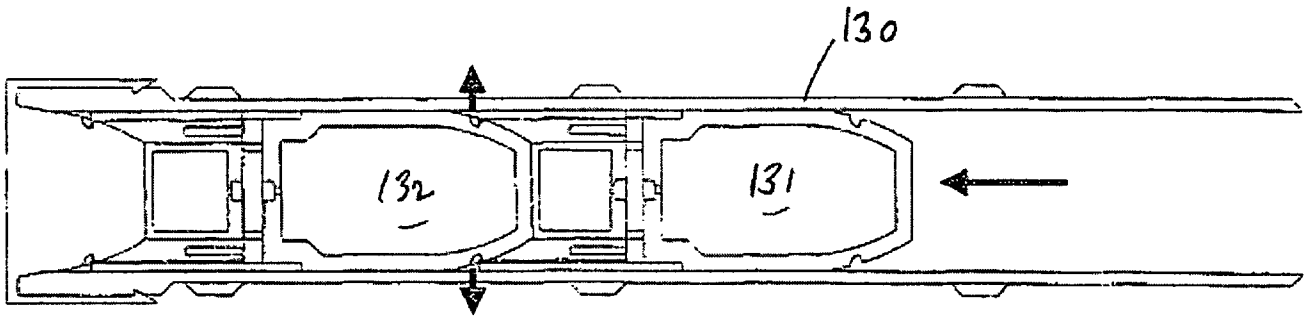
FIG. 13 indicates an additional sealing action.

FIG. 13 indicates a wedge sealing action which may be provided to reduce the flow of ignition gas around projectiles in a stack. A force (arrowed) down the receiver 130 caused by firing of a leading projectile slightly compresses the trailing projectiles 131 and 132. This in turn forces the tail assembly of the first trailing projectile 131 to expand radially over the nose of the second trailing projectile 132 to form a more robust contact with the bore of the receiver. The contact extends around the circumference of the bore and reduces or prevents passage of gas. A wedge action of this kind is preferably temporary and reversible, so that trailing projectiles return to their initial state in the barrel and can be unloaded if necessary, after leading projectiles have been fired. The tail assembly is constructed of a suitably resilient metal or synthetic material.

FIGS. 14*a*, 14*b*, 14*c* indicate an alternative clipping action which may be used to form a stack of projectiles either during loading into a barrel or separate from the barrel. FIG. 14*a* shows a projectile 140 with a set of clips 141 in an open condition. Each clip has an arm 142 with a hand 143 which engages a groove 144 on the nose of the trailing projectile. A moveable band 145 on the tail of the projectile sits in a position forward of the clips. FIG. 14*b* shows the band in motion towards the tail of the projectile, urging the arms inwards to a clipped position. The band can be moved as the projectile is loaded, or by hand if a stack is formed outside the barrel. FIG. 14*c* shows the band in a final position around the tail, with the arms parallel to the body of the projectile and the clips in a closed position. The trailing projectile has not been shown.

Figure 15D:
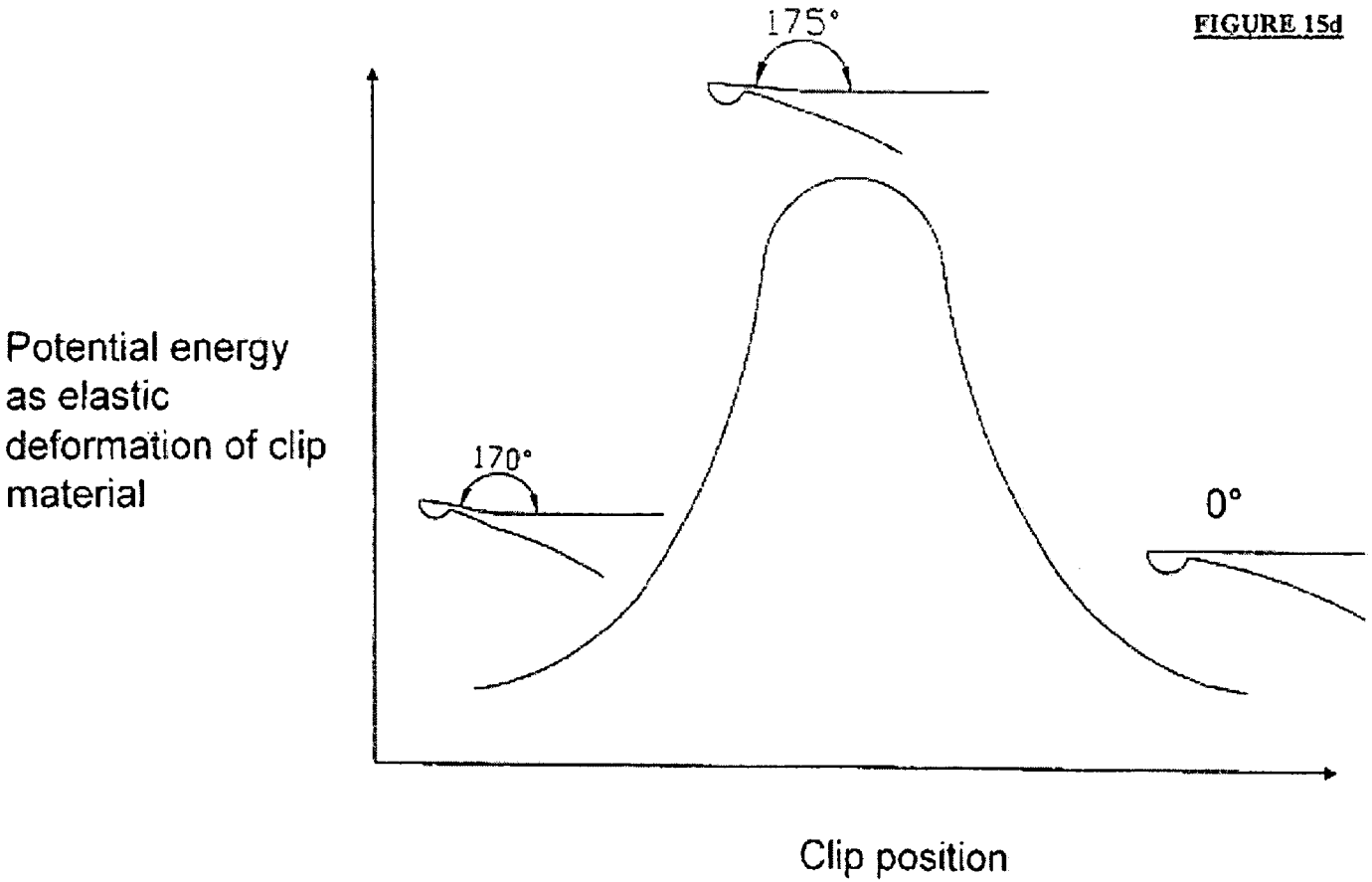

FIGS. 15*a*, 15*b*, 15*c*, 15*d* indicate a further alternative clipping action. Typical angles are shown by way of example. These figures represent a clip which makes beneficial use of dual rest potential energy states of the material the clips are made from. FIG. 15*c* shows a clip on a projectile in an open condition, the first position at which the clips are at rest potential energy state (see FIG. 15*d*). In this position the clips are in a rest geometry. FIG. 15*b* shows the clip in a maximum potential energy state due to tension and compression forces in the material (see FIG. 15*d*). When the clip is forced into this position by the action of inserting it into the breech or by pressing on the clip manually outside of the receiver, the material will exert a force to return the clip arm to either of its rest potential energy states being fully open as in 15*c* or fully closed as in 15*a*. FIG. 15*a* shows the second position at which the clips are at rest potential energy state, fully closed (see FIG. 15*d*). The use of a clip design incorporating a dual rest potential energy state and a maximum potential energy state between the two rest potential energy state geometries enables the clip to be activated by the insertion of the projectile into the barrel or manually by pressing the clip by hand, outside the barrel. Once the projectiles have been clipped together by either means, the clips will be in a rest potential energy state and will not unclip unless forced to do so by applying a cross-longitudinal force between projectiles. This means that a reload stick can be formed outside the barrel and that the projectiles will not unclip on an individual basis as they are removed from the receiver.

Figure 16A:
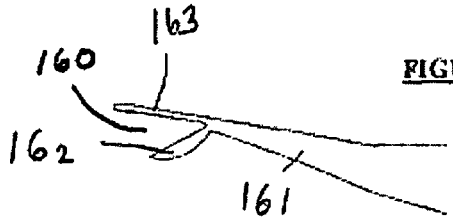
FIGS. 16*a*, 16*b*, 16*c*, 16*d* indicate a further clipping action.
Figure 16B:
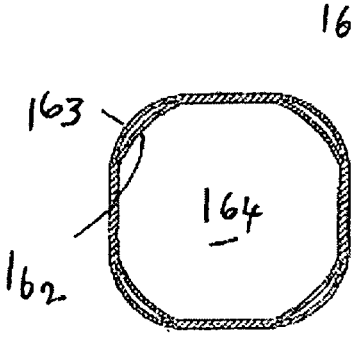
Figure 16D:
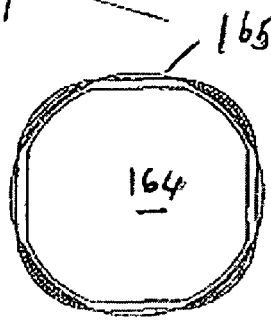
Figure 16C:
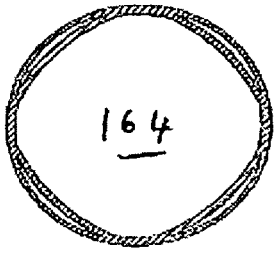

FIGS. 16*a*, 16*b*, 16*c*, 16*d* show a further alternative clipping action, with similarities to those described above. FIG. 16*a* shows an annular arm 161 with a hand including thumb 162 and finger 163. FIG. 16*b* is a schematic end view of the flexible tail 164 of a projectile in an unclipped condition. Four thumbs 162 and fingers extend from the annular arm 161. Thumbs and fingers join to form a single member at four 'less curving' sections around the annulus of the projectile skirt. FIG. 16*c* shows the tail 164 in a clipped condition with thumbs 162 held in place in an annular groove around the nose of a trailing projectile (not shown). In FIG. 16*b* the general shape of the tail is square to allow entry of the nose of a trailing projectile and to catch on the ramped entry section of the breech in ready position to be pushed into the receiver by the next projectile and consequently engage the nose of the next projectile with the 4 thumbs. In FIG. 16*c* the tail has been urged into the receiver and deformed by the nose of the trailing projectile into a generally circular shape to match the bore the barrel. FIG. 16*d* indicates the bore of the barrel 165 in relation to the fingers and thumbs.

The clip of FIG. 16 includes a cavity 160 between the finger 163 and thumb 162. The cavity 160 allows the thumb to flex outwardly to reduce the force required to pull the projectiles apart during firing. Alternatively, the depth of the cavity is designed to form a weakened portion at the base of the thumb 162 which yields to allow the thumb to move out of engagement with the adjacent projectile. The cavity 160 may be required for applications where the projectiles are not loaded in the field by hand, e.g. factory loaded into cartridges or directly into the launcher, whereby machine loading allows for the application of greater pushing force during loading which results in higher clipping forces. Without the cavity, such higher clipping forces may change the force required to pull projectiles apart during firing beyond a desirable amount. Similarly, the cavity 160 provides for a more consistent pull apart force when there are variations in temperature and manufacturing tolerances, barrel fouling etc which will affect the clipping force.

Figure 17A:
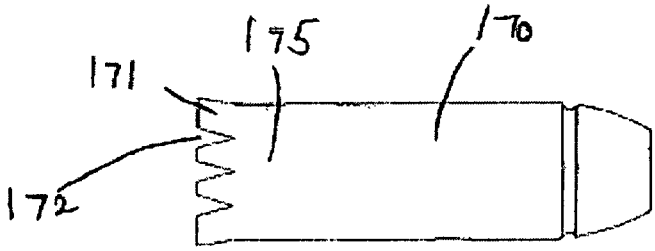
FIGS. 17*a*, 17*b* indicate a further clipping action.
Figure 17B:
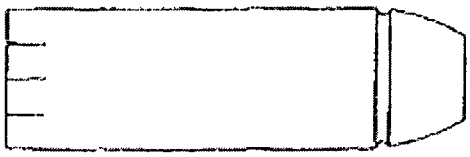

FIGS. 17*a*, 17*b* indicate a further alternative clipping action. A projectile 170 has flexible clips 171 on tail 175. Each clip may have an arm and hand structure as described above, for example. In FIG. 17*a* the projectile is unclipped, with clips 171 are splayed outwards from the tail and are separated by triangular slots 172. In FIG. 17*b*, the projectile is clipped to a trailing projectile (not shown) and the clips have engaged the nose of the trailing projectile. The triangular slots have closed as the clips bend inwards towards the nose of the trailing projectile. In flight the clips resume the unclipped orientation and may provide a small amount of drag to serve as tail fins or similar stabilizers.

Figure 18A:
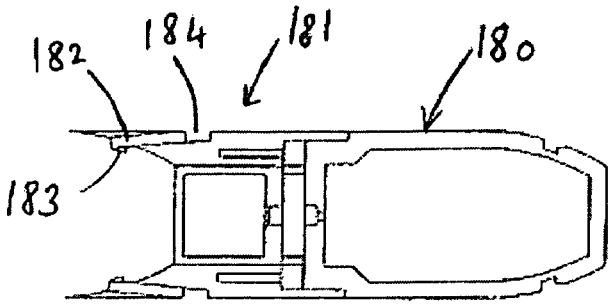
FIGS. 18*a*, 18*b* indicate a further clipping action.
Figure 18B:
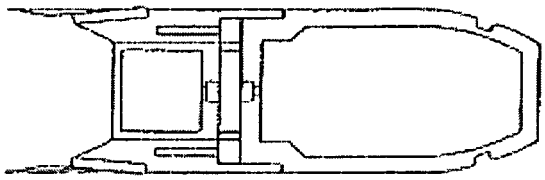

FIGS. 18*a*, 18*b* indicate a further clipping variation. The tail 181 of projectile 180 includes a series of spring loaded clips 182. Each clip has a pin 183 slides in an aperture 184 on the tail. The pins are either retractable or within their respective arms or have matching slots in the tail, part of respective apertures 184. FIG. 18*a* shows the projectile with the clips in an extended condition, urged rearwards on the tail with pins 183 extended. This represents the projectile after clipping, once clipped into a stack outside the receiver by manual operation or after formed into a stack by individually loading the projectiles into the receiver in similar fashion to previous embodiments. FIG. 18*b* shows the condition of the projectile and clips prior to the clipping process. As with prior embodiments, this clip abuts above the major diameter of the projectile such that when the projectile is inserted into the receiver the clips engage the ramped section of the breech and slide rearwardly in the projectile. As the clips slide rearwardly in the projectile during the insertion process a springy leaf of material or sprung pin moves into a hooking engagement position and engages the nose of the trailing projectile. Thus, the projectiles can be formed into a reload stick by the action of inserting them into the receiver individually or manually activating the clips to form a stick whilst the projectiles are outside the barrel. In this fashion the projectiles will not individually unclip during unloading from the receiver and will remain as a stick whilst outside the receiver.

Figure 19A:
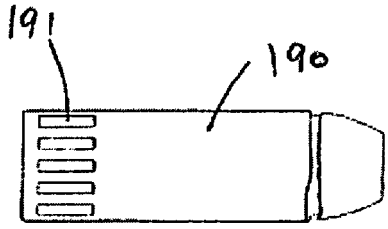
FIGS. 19*a*, 19*b* show a clippable projectile for an alternative firing system.
Figure 19B:
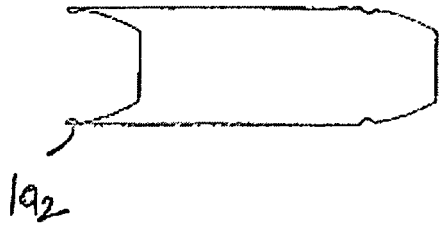
Figure 20:
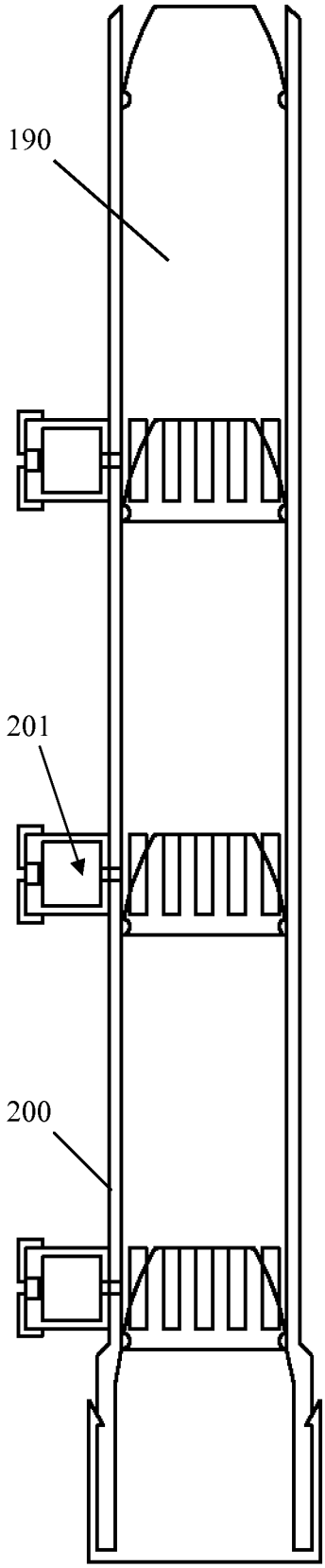
FIG. 20 shows an alternative firing system with external propellant chambers.

FIGS. 19*a*, 19*b* show an alternative projectile 190 for use in an alternative stacked firing system with external propellant chambers. FIG. 20 shows a barrel 200 with a firing system of this kind, such as described in WO 2000/62005 and WO 2004/102108. A stack of projectiles 190 are in place adjacent their respective propellant chambers 201. In FIG. 19*a*, the tail of the projectile includes an expansion space for propellant gases, defined by apertures 191. Various clipping systems may be included in the tail. FIG. 19*b* shows the end of the tail with a number of clips 192 such as described in relation to FIGS. 15*a*, 15*b*, 15*c*, for example. A range of other clipping systems may also be implemented.

Figure 21:
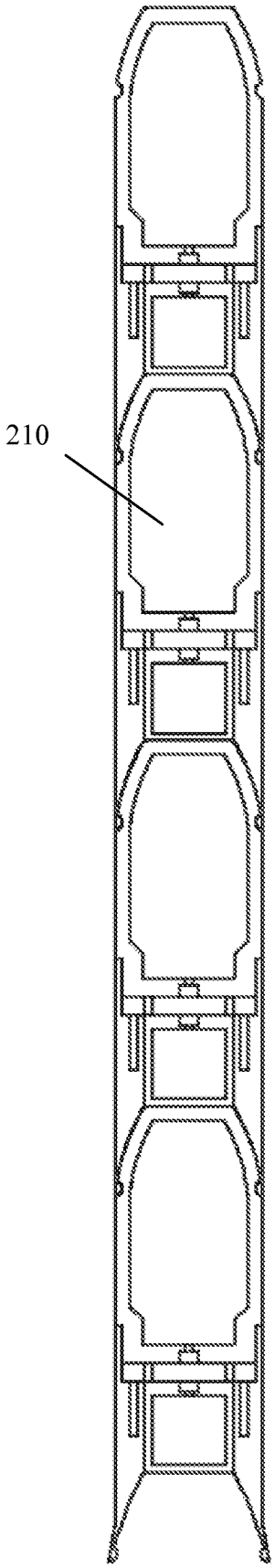
FIG. 21 shows a stack or clipped projectiles.
Figure 22A:
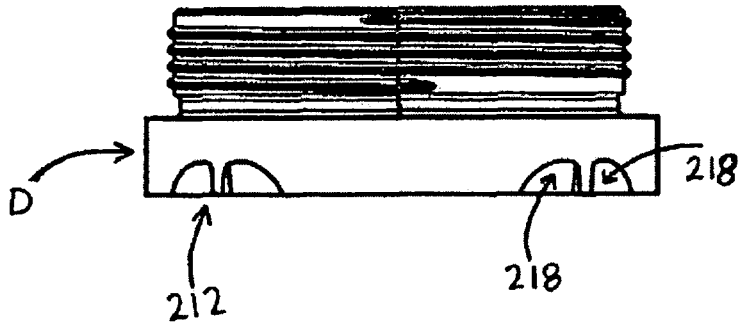
FIGS. 22*a* to 22*d* indicate a further clipping action of a projectile.
Figure 22B:
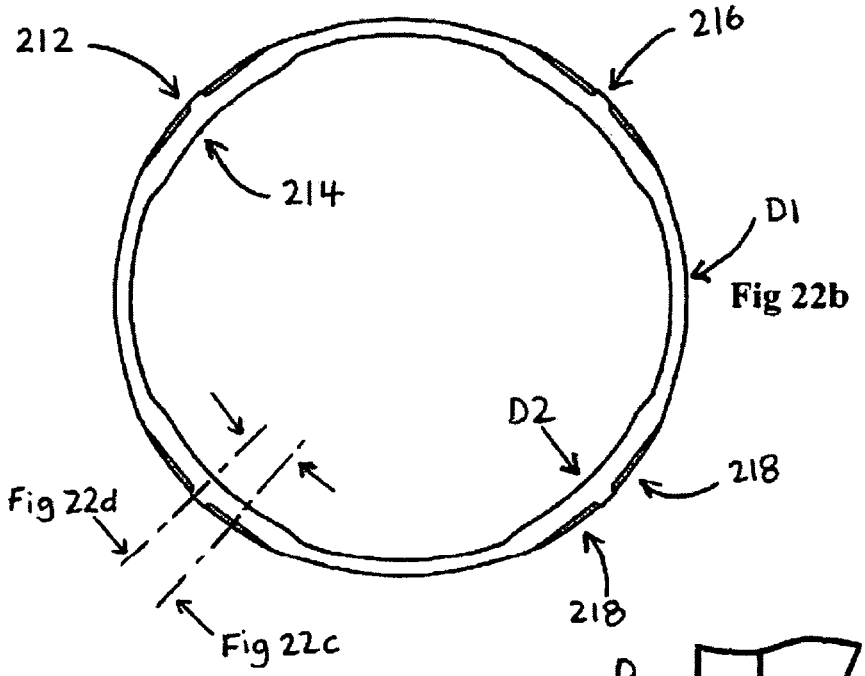
Figure 22C:
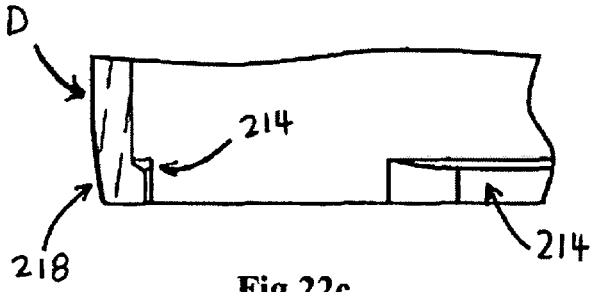
Figure 22D:
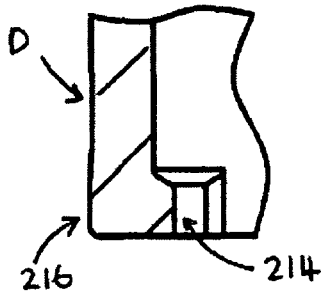

FIG. 21 shows a stack of projectiles 210 clipped together before insertion in a barrel. A range of clipping systems may be employed, such as the system in FIGS. 15*a*, 15*b*, 15*c*. A user could create a stack of projectiles of this kind in the field for example, for more convenient loading or for ease of transportation.

FIGS. 22*a* to 22*d* show an alternative of the clip of FIGS. 16*a* to 16*c*. This alternative is better suited for projectiles which can be loaded by hand. There are many factors that will increase the loading force, i.e. the force required to push a stack of projectiles into the barrel. These factors include manufacturing tolerances and materials variance, temperature, fouling and corrosion, wear and distortion of the barrel and projectiles.

The width of fingers 212 of the clip of FIG. 22 are reduced so as to reduce the outer surface 216 of the fingers. That is, the outer surface 216 of the finger 212 has a short dimension along the circumferential direction of the projectile compared to the equivalent dimension of the thumb 214. Reducing the size of the surface area 216 reduces the friction between the outer surface 216 of the fingers 212 and the bore of the projectile launcher as the projectile slides in the bore. The finger 212 may be formed by forming flats 218 on the outer circumference of the projectile. The general shape of the projectile tail may be circular and have a diameter D which allows for a sliding fit with the bore of the projectile launcher across a range of operating environmental conditions. The outer surface 216 of the fingers 212 protrude radially outwardly from the diameter D of the circular tail and contact the breech and bore to activate the clip during loading and maintain the clip in a closed position. The clipping force can be readily varied by varying the extent to which the finger 212 protrudes.

The cavity between the finger 212 and thumb 214 may be omitted, as shown in the embodiment of FIG. 22, whereby the finger 212 and thumb 214 may be integrally formed as a simple single piece. In the example shown in FIG. 22, the finger 212 is shaped like a short fin and the thumb 214 is shaped like a short section of an annular bead. The trailing end of the fin shaped finger 212 overlaps the thumb 214 in the vicinity of its mid point. The overlapping finger and thumb form a radially orientated pin or column through which the radial clipping forced applied by the breech and bore can be transmitted. The finger 212 provides for a third portion which activates a second portion, provided by the thumb 214, during the loading process to cause the second portion to engage the trailing projectile. The surface 216 and hence column provides a transfer of forces as a substantially point load compared to the circumferential and axial dimensions of the thumb 214.

The flats 218 may be omitted and the bead shaped thumbs 214 may join to form one continuous annular bead. A projectile with such clips would be less flexible and hence would required more loading force to activate but would result in a stronger projectile for withstanding forces in higher propellant pressure applications. Rather than being fin shaped, the finger 212 may simply be formed as a projection. However such a finger would be more likely to be sheared off during handling or loading. Furthermore, such a finger 212 would also provide less uniform clipping forces where there is any pivoting movement in the clip such as in the current example where the clip is at the end of the projectile.

The embodiment shown in FIG. 22 overcomes these disadvantages. The ends of the bead shaped thumb 214 and the leading end of the fin shaped finger 212 provide pivot points about which the other, more massive parts of the finger and thumb can pivot. Similarly, the edges of the flats 218 provide pivots. While these features provide flexibility they leave enough strength in the material of the projectile to withstand the high forces applied during firing such as hoop strength present when the propellant gases expand from within the projectile.

A projectile may include any number of clips; from just one to 8 or more. The number of clips on a projectile will vary depending on the application of the projectile and launcher, the material of the components of the projectile, whether it is a low velocity, medium velocity or high velocity projectile, whether it must be able to be hand loaded, etc. The trailing projectiles in a stack of high velocity projectiles will experience higher pull apart forces, resulting in undesired separation in the barrel, than in a stack of low velocity projectiles. Similarly, a projectile being fired must remain in position, at the lead of the stack, until the desired time during the propellant burn. While a projectile may include just a single clip, a number of clips are preferably arranged symmetrically about the longitudinal axis of the projectile; particularly where the projectile is spin stabilized.

A number of the clips of FIG. 22 can readily be integrally moulded into a projectile of the tail thereof.

A lesser number of clips means that each clip will need to contribute to resisting the pull apart forces. Hence a projectile that can be hand loaded may ideally include three or four clips even though the total area of the outer surfaces 216 of the three or four clips which contacts the breech and bore will be greater than, for example, two clips. The material and height, width and circumferential length of the, e.g., bead shaped thumb 214 will also determine the force required to pull the projectiles apart during firing as well as the clipping force applied by the finger 212.

When engaged with a groove adjacent a leading end of a trailing projectile or breech closure such as is shown in FIG. 12, the thumb 214 will engage behind the leading edge of the groove. The internal diameter D2 determined by the inwardly directed dimension of the thumb 214 may be less than the external diameter of the leading edge of the groove. This will allow a light engagement between projectiles so that projectiles can be pre-assembled outside the barrel or so that projectiles can be more easily unloaded by pulling a stack back out through the breech. However, this light or pre-assembly engagement of the clip is insufficient for the clip to withstand the in barrel forces it is required to withstand during firing.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments. The order of description of the above method should not be considered limiting, and methods may use the described operations out of order or with omissions or additions.

It is to be understood that the above description is intended to be illustrative, and not restrictive. Many other embodiments will be apparent to those of ordinary skill in the art upon reviewing the above description. The scope of the invention should, therefore, be determined with reference to the appended claims, along with the full scope of equivalents to which such claims are entitled.

What is claimed is:

1. A clip for a projectile for a stacked projectile launcher including a receiver having a breech portion adapted to receive a projectile and a breech closure, the clip comprising:

a first portion for engagement with the projectile, a second portion connected to the first portion for engagement with a trailing projectile or the breech closure to form a stack, and a third portion which activates the second portion during a breech loading process to cause the engagement with the trailing projectile or the breech closure, the third portion having a surface for contacting the launcher for effecting the activation of the clip and being configured to be deflected or displaced by the breech portion of the projectile launcher during loading of the projectile launcher, wherein the dimension of the surface of the third portion in a direction along the circumference of the projectile is less than an the circumference of the projectile.

2. A clip according to claim 1 wherein the surface of the third portion in a direction along the circumference of the projectile is less than an equivalent dimension of the second portion which engages the trailing projectile or the breach closure.

3. A clip according to claim 1 wherein the second and third portions are integrally molded.

4. A clip according to claim 2 wherein the third portion is fin shaped.

5. A clip according to claim 1 wherein the second portion and third portion over lap along substantially a radius of the projectile.

6. A clip according to claim 1 wherein the second portion is bead shaped.

7. A clip according to claim 1 wherein the first portion is integral with a part of the projectile.

8. A clip according to claim 1 including a plurality of second and third portions.

9. A clip according to claim 1 wherein the second portion is shaped to engage a groove on the nose part of the trailing projectile or the breech closure.

10. A clip according to claim 6 wherein a forward end surface of the second portion is sloped.

11. A clip according to claim 6 wherein the length of the bead extends a short section.

12. A clip according to claim 1 wherein the second portion is configured to partially engage with the trailing projectile or the breech closure during a manual stacking process outside the breech of the launcher.

13. A projectile or a tail assembly for a projectile including a clip according to claim 1.

14. A clip according to claim 1 wherein the third portion is formed by two flats on an outer surface of the clip.

15. A clip according to claim 6 wherein the second portion and third portion over lap to form a pin or column.

16. A clip according to claim 1 wherein first portion is molded with a part of the projectile and wherein the part is threaded for engaging a payload of the projectile or within a tail assembly of the projectile.

17. A projectile or tail assembly for a projectile including a plurality of clips according to claim 1 wherein the clips are separated by slots.

18. A projectile or tail assembly according to claim 13 wherein the clip includes a moveable band for holding the clips in engagement with the trailing projectile or the breech closure.

19. A projectile or tail assembly for a projectile including one or more clips according to claim 1 and wherein the one or more clips slide relative to the remainder of the projectile or tail assembly to activate the clip into engagement with the trailing projectile or the breech closure.

20. A projectile or tail assembly for a projectile including one or more clips according to claim 1 wherein the surfaces of the third portion have a circumferential shape which is deformed into a circular shape during the loading the projectile into the launcher to activate the engagement.

* * * * *